United States Patent [19]

Gorski et al.

[11] Patent Number: 5,026,205

[45] Date of Patent: Jun. 25, 1991

[54] APPARATUS AND METHOD FOR CONTINUOUSLY REMOVING EXISTING REINFORCED PAVEMENT AND SIMULTANEOUSLY REPLACING THE SAME BY A NEW PAVEMENT

[76] Inventors: George L. Gorski; Donald D. Zamzow, both of P.O. Box 358, Wausau, Wis. 54402-0358

[21] Appl. No.: 456,796

[22] Filed: Dec. 29, 1989

Related U.S. Application Data

[63] Continuation-in-part of Ser. No. 292,053, Dec. 20, 1988.

[51] Int. Cl.[5] ..... E01C 23/12; E01C 19/46

[52] U.S. Cl. ..... 404/72; 241/101.7; 404/91

[58] Field of Search ..... 299/14, 36, 37, 69; 404/72, 90, 91, 92, 133; 241/101.7

[56] References Cited

U.S. PATENT DOCUMENTS

| | | | |
|---|---|---|---|
| 2,768,794 | 10/1956 | Putnam | 404/90 |
| 3,510,073 | 5/1970 | Mailliard | 404/91 X |
| 4,309,126 | 1/1982 | Pfaff | 299/37 X |
| 4,560,207 | 12/1985 | Eftefield et al. | 299/10 |
| 4,692,058 | 9/1987 | Mengel | 404/90 X |

FOREIGN PATENT DOCUMENTS

| | | | |
|---|---|---|---|
| 2625519 | 7/1989 | France | 404/92 |

OTHER PUBLICATIONS

*Civil Engineering,* 5/1985, "New Pavement from Old Concrete", pp. 56–58.

*Primary Examiner*—Ramon S. Britts
*Assistant Examiner*—David J. Bagnell
*Attorney, Agent, or Firm*—Lowe, Price, LeBlanc & Becker

[57] ABSTRACT

A mobile pavement replacement system (MPRS) is provided for forcibly drawing a flexibly-supported, acute-angled wedge under an existing stretch of a predetermined width of reinforced pavement to initiate removal thereof from the ground below. Gravity-assisted impact hammers apply downward blows of a controlled magnitude and at a predetermined rate onto an upper surface of the reinforced pavement, to crack the same across the entire width thereof over the wedge being driven therebelow. The wedge is flexibly supported, with a predetermined amount of elasticity in the up-and-down direction, so that it essentially "floats" and facilitates absorption of the impact forces by the reinforced pavement to be cracked thereby. Cracked reinforced pavement is subjected to further blows by a hammer coacting with a set of bars transverse thereto, to forcibly render a bulk component of the reinforced pavement into small pieces separated from reinforcement material contained therein. The reinforcement material, is now separated from the bulk component, chopped up and delivered in a flow separate from that of the rendered bulk component. The rendered materials are selectively combined with other suitable materials and integrated into a replacement pavement continuously laid in the wake of the moving MPRS.

17 Claims, 11 Drawing Sheets

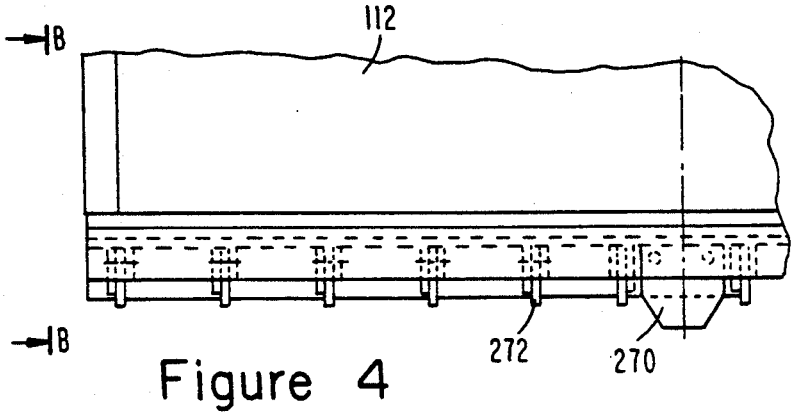
Figure 4
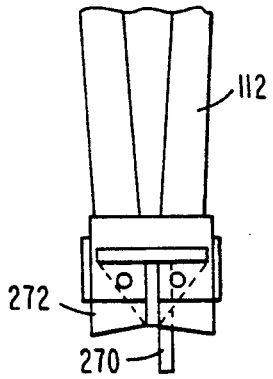
Figure 5
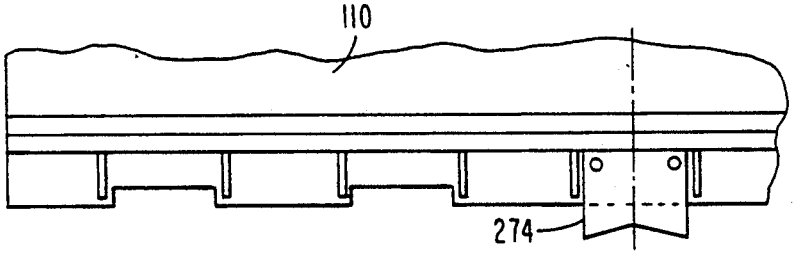
Figure 6
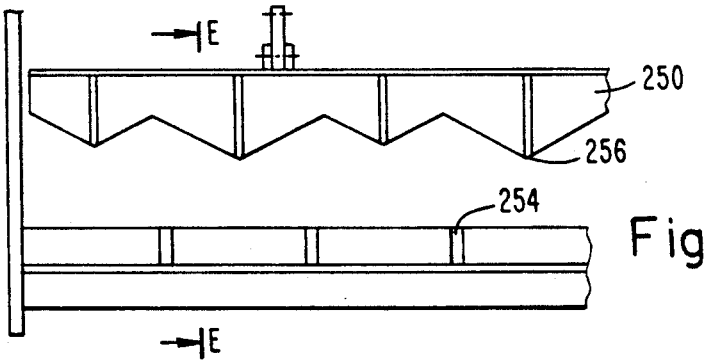
Figure 7
Figure 8
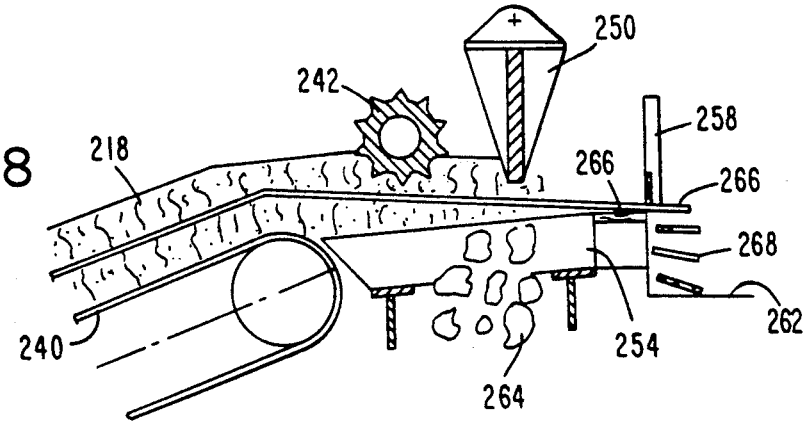

APPARATUS AND METHOD FOR CONTINUOUSLY REMOVING EXISTING REINFORCED PAVEMENT AND SIMULTANEOUSLY REPLACING THE SAME BY A NEW PAVEMENT

This application is a Continuation-in-Part of U.S. patent application Ser. No. 07/292,053 filed on Dec. 30, 1988.

FIELD OF THE INVENTION

This invention relates to apparatus and a method for continuously breaking up and removing reinforced road pavement and, more particularly to an apparatus and a method for simultaneously separating a bulk component from a reinforcement component of the reinforced pavement and rendering both components for delivery thereof into separate flows for selective utilization thereof into a replacement pavement.

BACKGROUND OF THE INVENTION

Many existing highway systems as well as substantial portions of the landing zones of air fields for receiving large and heavy aircraft are formed of reinforced concrete pavement. Inevitably, with the passage of time and upon subjection to various forces during use, even such reinforced pavement suffers deterioration and must eventually be replaced. Even otherwise, as when an existing highway must be replaced by a wider or sturdier highway to accommodate changing needs, existing reinforced pavement often needs to be removed and/or replaced.

Although numerous forms of pavement breaking apparatus and methods are in use today, they tend to be relatively inefficient and slow, at times labor intensive, and highly disruptive of existing traffic patterns. Known apparatus of this type ranges from the simple pick and shovel known since biblical times, through pneumatic or hydraulic jackhammers and front end loaders that require skilled personnel to operate safely, to assorted power-driven multi-bladed devices that more or less chop up existing pavement in place to serve as a base for an additional layer of fresh pavement thereon. Such apparatus and methods for using the same leave much to be desired.

U.S. Pat. No. 4,692,058 to Mengel, issued on Sept. 8, 1987, discloses apparatus and a method for removing pavement wherein an acute-angled wedge, wider than pavement that is to be broken up and removed, is forced under the pavement to exert a force to lift it off the underlying ground. lA heavy, pivoted, and preferably hydraulically driven hammer hits the pavement above the front edge of the wedge and cracks the pavement at every few inches of its length by generating tensile forces in the lower portions of the lifted pavement under the applied impact force. A second hammer having a saw tooth impact surface profile thereafter renders the cracked pavement and any tensile reinforcement material included therein into smaller pieces but does so without separating the bulk component of the reinforced pavement, e.g., concrete material, from the tensile reinforcement material, typically steel bars or netting. In this apparatus, the acute-angled wedge rests on the underlying ground from which packed pavement has been lifted by the wedge, the heavy hydraulically driven hammer is pivotably supported on a ramp drawn directly behind the wedge to force the wedge under the approaching pavement.

A need exists for apparatus and a method that can in a single pass rapidly and economically break up a substantial width of existing pavement to totally remove the same from the underlying ground while simultaneously separating the bulk component of the pavement from relatively valuable reinforcement material and for rendering both components into small pieces that are more easily handled and, therefore, more useful forms thereof. Preferably, these rendered constituents are immediately but selectively utilized in combination with other suitable materials, to lay down replacement pavement.

DISCLOSURE OF THE INVENTION

Accordingly, it is an object of this invention to provide apparatus for continually, rapidly, and economically breaking up and removing a substantial width of an existing reinforced pavement.

It is another object of this invention to provide apparatus and a method for continually, rapidly, and economically breaking up and removing a substantial width of an existing reinforced pavement and for rendering the same into small pieces of predetermined size for easy removal thereof.

It is yet another object of this invention to provide apparatus for continually, rapidly, and economically breaking up a substantial width of an existing reinforced pavement, including any reinforcement material therein, and for separating a bulk component of the pavement from the reinforcement material for subsequent reuse thereof.

It is yet another object of this invention to provide apparatus and a method for continually, rapidly, and economically breaking up a predetermined portion of an expanse of existing reinforced pavement and to leave the ground underneath substantially ready to receive new pavement immediately thereafter.

It is a further object of this invention to provide apparatus and a method for continually, rapidly, and economically breaking up a predetermined width of existing reinforced pavement, separating a bulk component thereof from any reinforcement therein, for rendering both the bulk component and the reinforcement for delivery as separate flows, and for optionally distributing the bulk component in its rendered form onto ground from which reinforcement pavement was removed for the formation of replacement reinforced pavement immediately thereafter.

It is a further related object of this invention to provide apparatus and a method for continuously, rapidly and economically breaking up a predetermined width of existing reinforced pavement, separating a bulk component thereof from any reinforcement therein, rendering the same, and selectively combining the rendered material in combination with other suitable materials to form a new pavement to replace the removed pavement.

These and other objects of this invention are realized in a preferred embodiment of the apparatus by providing a mobile system that advances to remove an existing layer of reinforced pavement, the system including a driving means for providing a forward drive to the system, movable lifting means driven forwardly by the drive means for thereby lifting a predetermined width of approaching reinforced pavement, impact means for applying gravity assisted controlled impact forces to the lifted reinforcement pavement to generate successive cracks therein substantially across the width thereof, means for rendering into pieces a bulk component of the cracked reinforced pavement for separating the pieces thereof from the reinforcement component and for delivering the rendered bulk component pieces in a first flow, and means for rendering the separated reinforcement component into pieces and delivering the same in a second, wherein both the bulk component rendering means and the reinforcement component rendering means are adapted to be moved in concert with the lifting means and the impact means by the driving means.

BRIEF DESCRIPTION OF THE DRAWINGS

FIG. 4 is a partial elevation view of one of two gravity assisted impact hammers according to a preferred embodiment of this invention (view A—A per FIG. 2B).

FIG. 5 is a partial and elevation view of the impact hammer of FIG. 4 (view B—B per FIG. 4).

FIG. 6 is a partial elevation view of a second hydraulic impact hammer according to a preferred embodiment of this invention, illustrating in particular a removable lane separator element attachable thereto (view C—C per FIG. 2B).

FIG. 7 is a partial elevation view of a bulk component rendering hammer according to a preferred embodiment of this invention (view D—D per FIG. 2B).

FIG. 8 is a partial side elevation view of means for rendering and separating a bulk component of removed reinforcement pavement according to a preferred embodiment of this invention (view E—E per FIG. 7).

Like elements and parts of elements are identified by the same numbers in all the figures and throughout the specification.

DESCRIPTION OF THE PREFERRED EMBODIMENTS

A significant feature of this invention is the provision of a number of mobile units, some of which contain novel and non-obvious features and some of which are of known type, the operational coaction of selected ones of which is readily controlled by a single operator. The operator is most conveniently positioned in the forwardmost unit to view not only oncoming reinforcement pavement that is to be removed but also the other operating system units as well as any coworkers engaged nearby in the operation.

To gain an overview of the principal components of the system according to a preferred embodiment of this invention, reference should be had to FIGS. 1, 1A–1C and 9–11 as viewed from left to right in succession. Thus, per FIG. 1, the entire system consists of a chain of connected and/or coacting elements advancing in the forward direction as indicted by the bold arrow above the left-hand side of FIG. 1.

Figure 1:
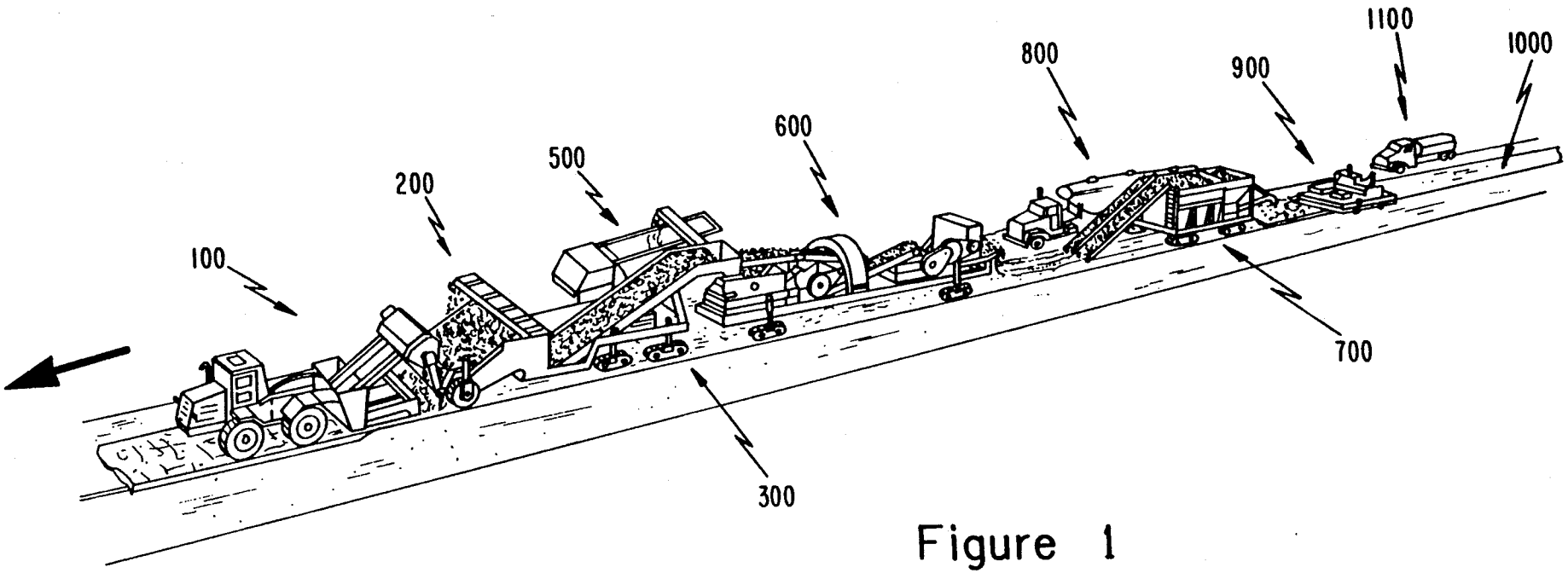
FIG. 1 is a perspective overall view of the coacting units and elements that combine to form a mobile pavement replacement system (MPRS) according to a preferred embodiment of this invention.
Figure 1A:
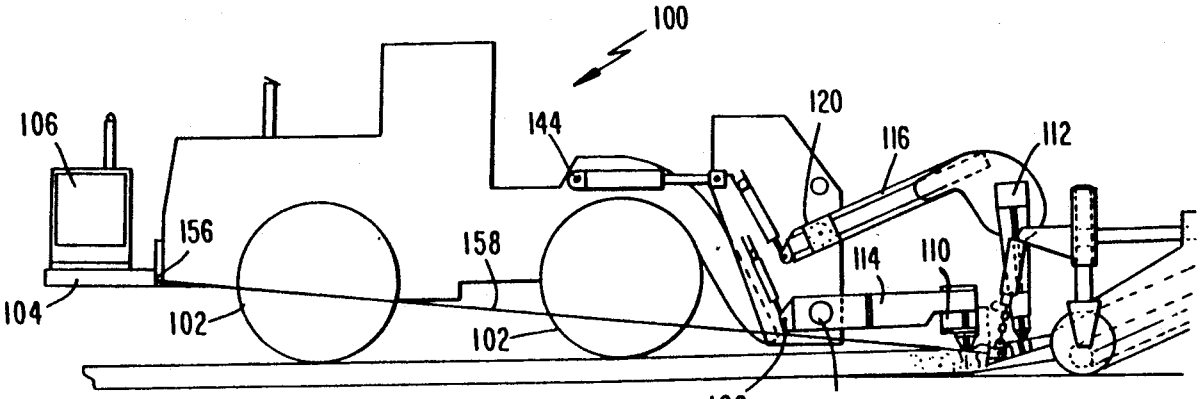
FIGS. 1A, 1B and 1C are side elevation views of certain successive portions of the PRC according to a preferred embodiment of this invention.

The forwardmost principal mobile unit of the advancing system in the preferred embodiment of the apparatus, as best seen in FIGS. 1 and 1A, is a large, powerful, heavy-duty tractor unit 100 that rides on a portion of the reinforced pavement that has not yet been lifted from the underlying ground by the advancing MPRS. As a practical matter, the operator of the system may most comfortably be situated in a cab of tractor unit 100 where he or she would have a clear view in the direction of advancement of the system as well as the components that follow tractor unit 100. A control system of known type (not illustrated or discussed in detail for conciseness and simplicity) is provided for use by the operator to control various operational parameters as discussed more fully hereinbelow. It should be understood that there are available nowadays quite sophisticated control systems that include programmable microprocessors and the like for one-operator control of many coacting units, e.g., mining equipment, manufacturing assembly lines, etc. Similar controls are contemplated for use in the present invention, but cooperative involvement by more than one person in operating the MPRS is feasible and may even be desirable. Separate operators to drive and operate individual trucks, etc., is of course necessary even as a single operator controls the "train" of cooperating and synchronously moving units of the MPRS proper.

Figure 1B:
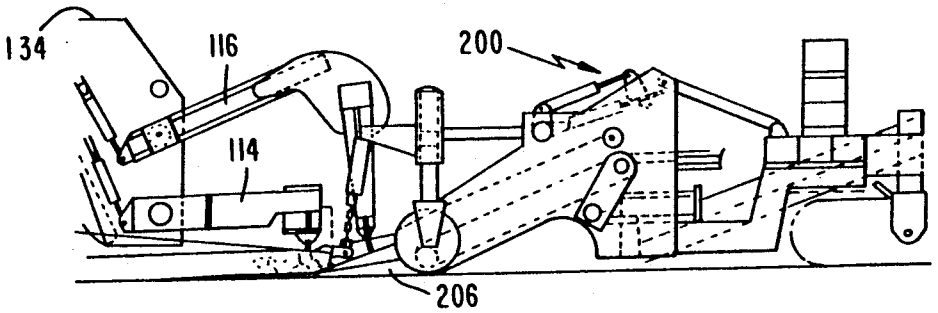
Figure 2A:
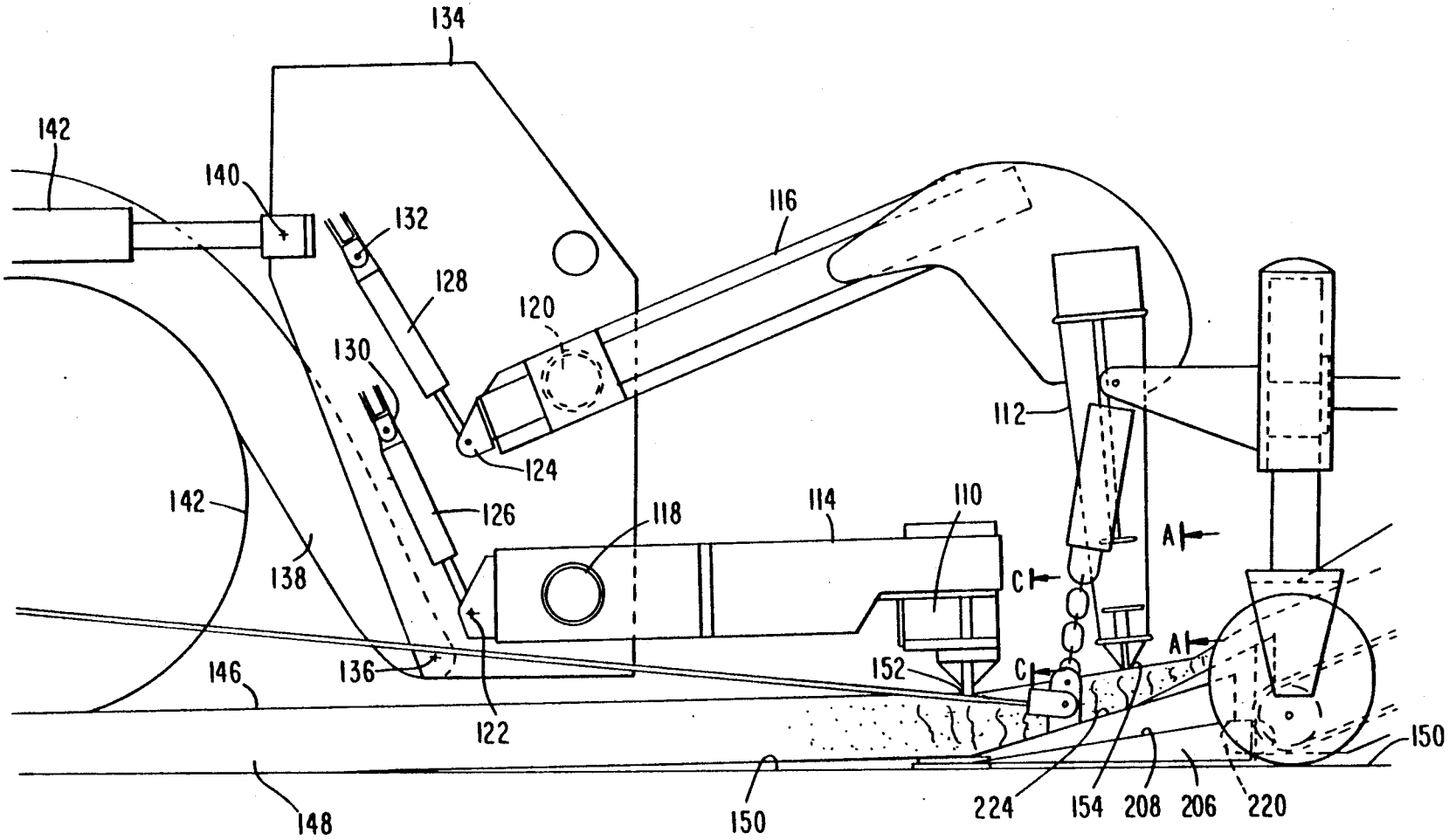
FIGS. 2A and 2B are enlarged elevation views of important coacting elements as illustrated to a smaller scale in FIG. 1B.
Figure 2B:
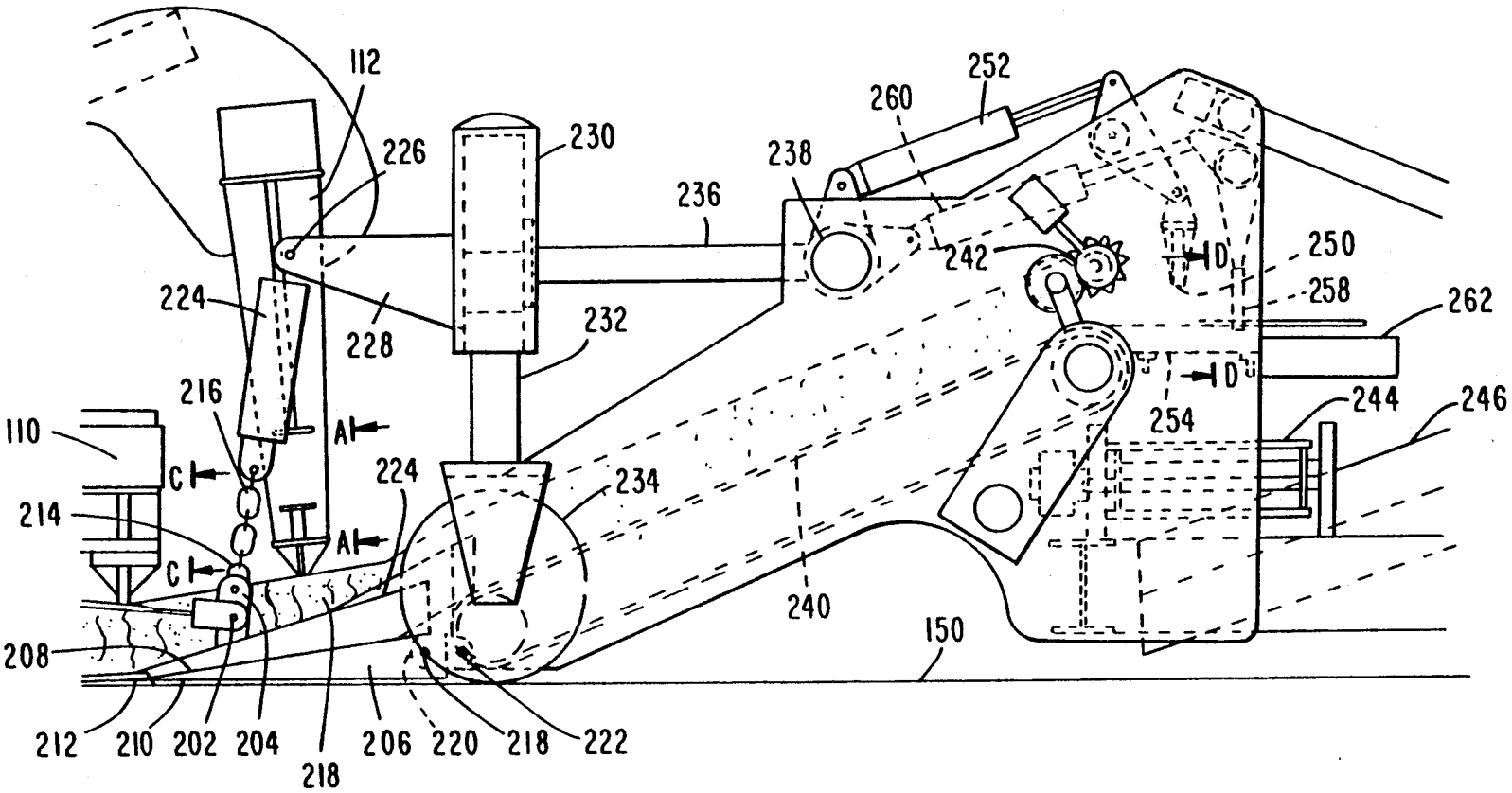

Tractor unit 100 tows immediately behind it a towed mobile unit 200, best seen in FIGS. 1B and 2B, that is preferably supported at its forward end by pneumatic tired wheels supported by the earth's surface newly exposed by removal of reinforcement pavement therefrom and, at a rear end, preferably by a tracked support unit 300 that may be provided with its own motive power and which is capable of bearing the substantial load of a significant length of removed reinforcement pavement and assorted rendering elements as also more fully discussed hereinbelow.

Figure 1C:
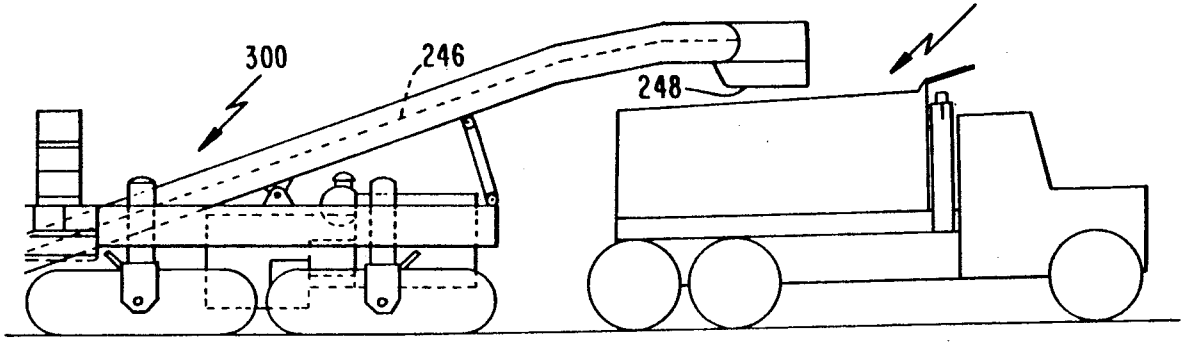

The track-supported unit 300, as best seen in FIG. 1C, supports an inclined conveyor belt for optionally conveying rendered pieces of a bulk component, e.g., broken concrete, from the removed reinforced pavement for delivery to, for example, a heavy duty track 400. In the alternative, as best understood with reference to FIGS. 1, 10 and 11, the rendered pieces of removed bulk component from the removed reinforced pavement may be distributed evenly behind the moving system to be integrated into new reinforced pavement formed by combining the same with other suitable materials.

Figure 3A:
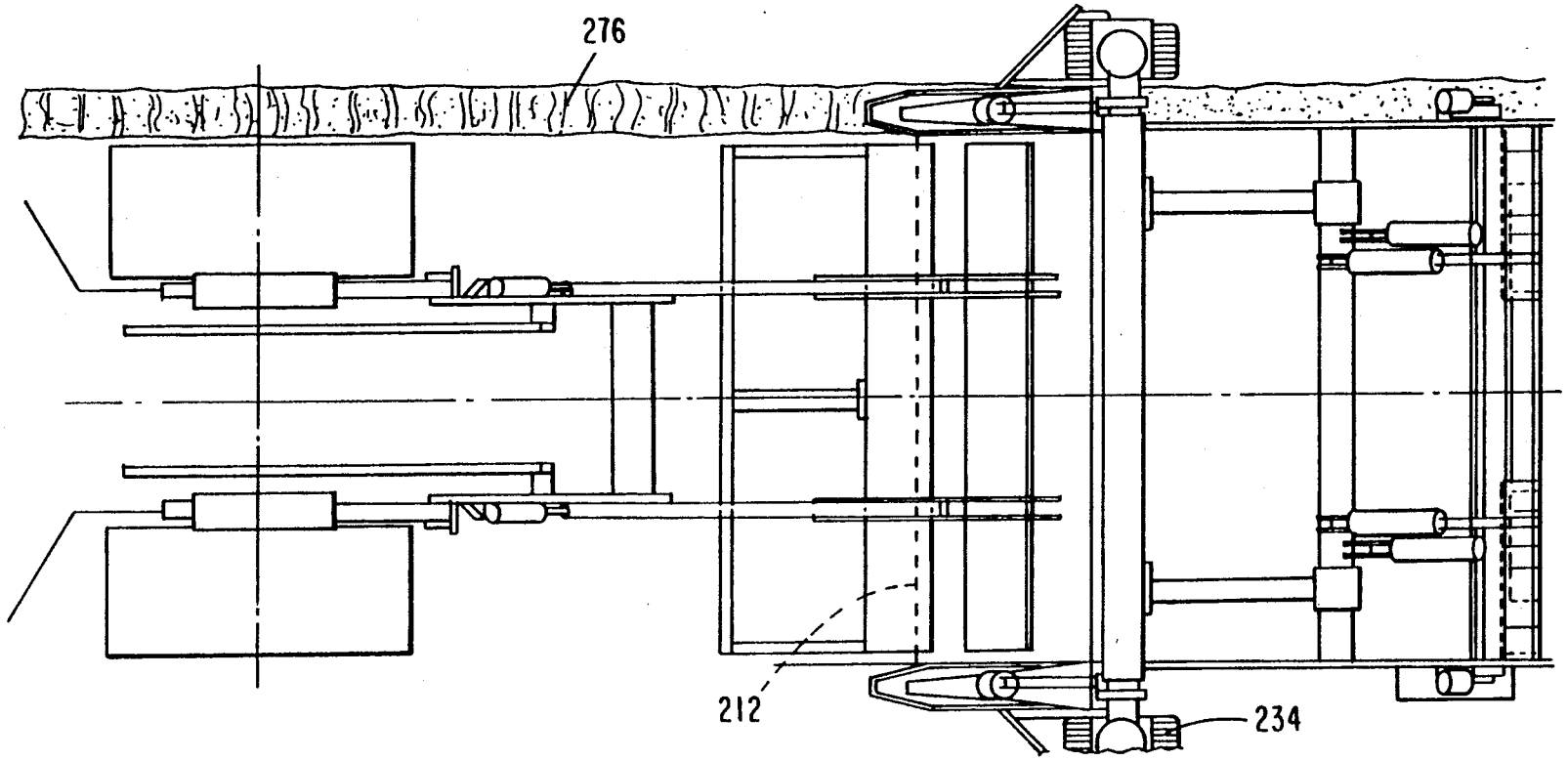
FIGS. 3A, 3B and 3C are partial plan views of the apparatus according to a preferred embodiment of this invention, particularly those portions that are illustrated in elevation view in FIG. 1B, 2A and 2B.
Figure 3B:
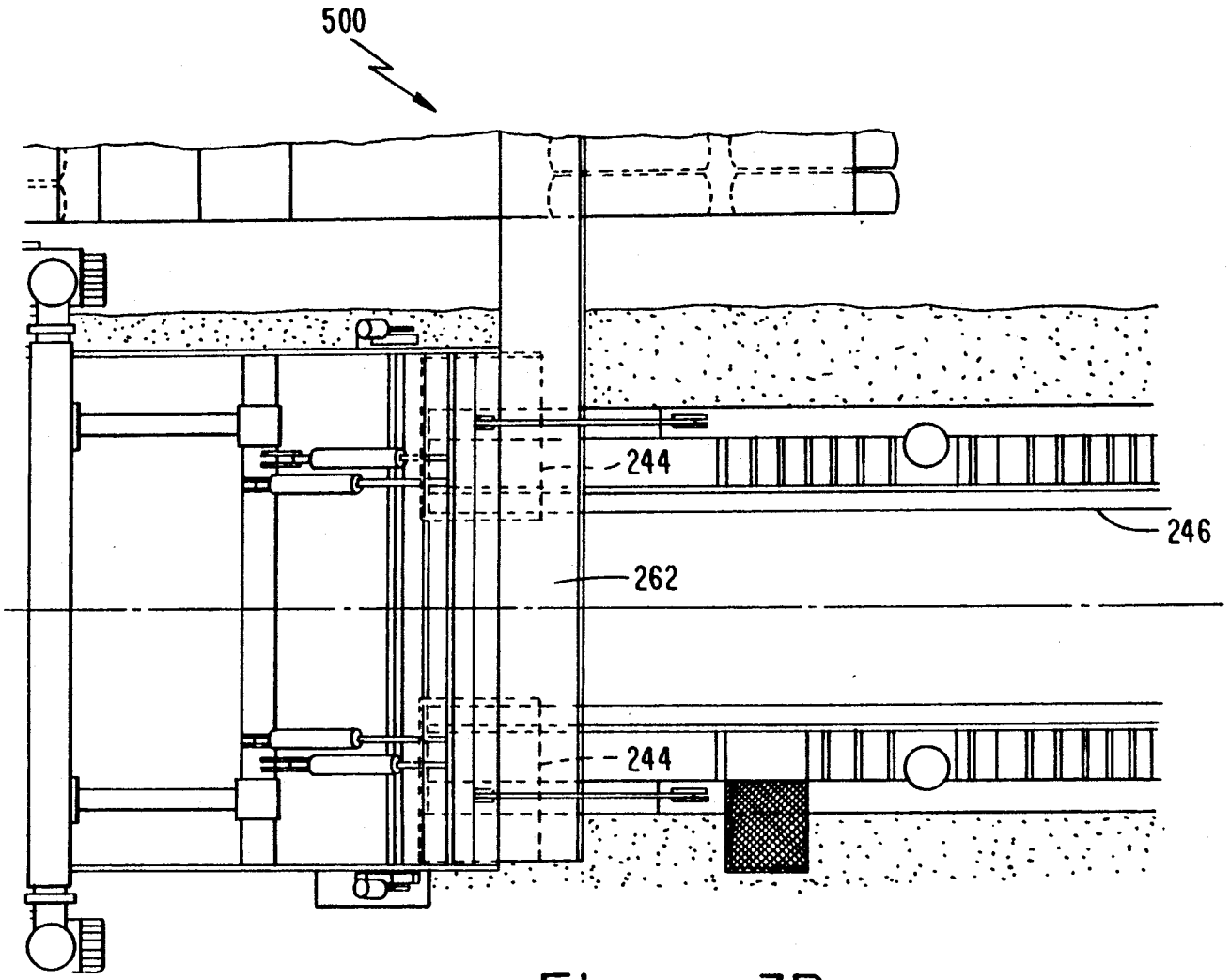
Figure 3C:
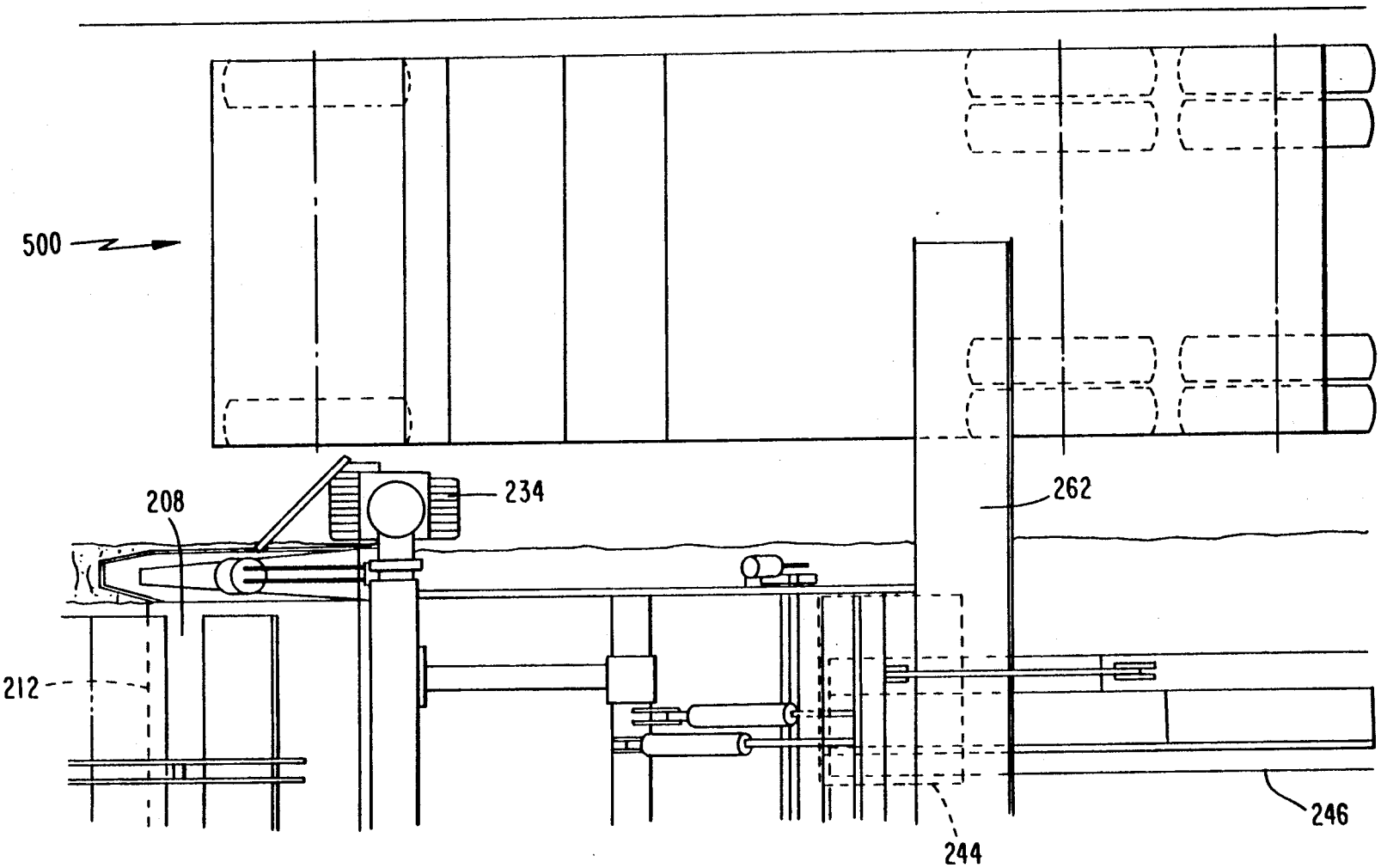

As is best seen in one option according to FIGS. 3B and 3C, pieces of the rendered reinforcement component are conveniently delivered to one side of the moving system, preferably to be collected in a heavy-duty truck 500 moving alongside the system to receive and periodically take away the pieces of reinforcement material.

Tractor vehicle 100, preferably provided with pneumatic tires 102 to enable it to cope with the repeated shock loads encountered during use, is conveniently provided with a forwardly extending platform 104 to support a hydraulic pressurization unit 106 with its own independent drive engine. Hydraulic pressurization unit 106 (omitted from FIG. 1, but illustrated in one optional mounting position on tractor 100 in FIG. 1A) provides a supply of hydraulic fluid at a selected high pressure to enable controlled operation of, preferably, two gravity-assisted pivotally supported impact hammers, forward hammer 110 and rear hammer 112. These pavement-cracking hammers are supported at the ends of pivotable arms 114 and 116 that pivot about strong, suitably sized pivots 118 and 120, respectively. Also best seen in FIG. 2A, hammer arms 114 and 116 each extend to the other side of their respective pivots 118 and 120 and are there respectively connected at pivots 122 and 124 to hydraulically driven pistons contained in hydraulic cylinders 126 and 128, respectively. Hydraulic cylinders 126 and 128 are pivotally mounted at their respective closed ends at pivots 130 and 132, respectively, to a pivotally supported hammer-mounting element 134 which is itself pivotable about a pivot 136 at the distal end of an extension 138 mounted to tractor vehicle 100. Hammer-mounting element 134 is also connected at a closed end to a hydraulic cylinder 142 at a distal end 140 of a piston thereof, with hydraulic cylinder 142 having pivot 144 mounted to tractor vehicle 100.

Strong hydraulic lines, of known type and suitable rating, connect hydraulic pressurizing unit 106 to hydraulic cylinders 126, 128 and 142 to generate pivoting of hammer arms 114 and 116 and of hammer-mounting element 134 about their respective pivots 118, 120 and 136.

As persons skilled in the mechanical arts will appreciate, the provision of a high pressure fluid to cylinder 126 in a controllable manner can be used to pivot hammer arm 114 so as to raise forward hammer 110 to a suitable height above the level of the uppermost surface 146 of a reinforced pavement layer 148 resting on underlying ground 150. Upon release of pressure from hydraulic cylinder 126, the weight of hammer arm 114 and forward hammer 110 will immediately subject both to the action of the earth's gravitational field and cause them to drop so that a carefully shaped impact end of hammer 110 makes a forcible impact on the upper surface 146 of reinforcement pavement 148 at a first impact location 152. In actuality, depending upon the specific geometry provided to the impacting portion of forward hammer 110, this contact portion 152 may be an aggregation of contact points stretching transversely across a selected width of the reinforced pavement in a direction normal to the direction of motion of tractor vehicle 100.

In a very similar manner, rear hammer 112 can be raised and dropped by suitable control of the hydraulic pressure provided to hydraulic cylinder 128 to thereby generate gravity assisted impacts downwardly onto reinforcement pavement layer portion 154 that has already been subjected to one or more blows by first hammer 110. Rear hammer 112, again depending upon the specific geometry of its impact points, makes contact with the reinforced pavement at a location 154 which may itself be an aggregation of impact points stretching transversely across the reinforced pavement.

By suitable selection of the masses of hammer arms 114 and 116 as well as hammers 110 and 112, the respective heights to which hammers 110 and 112 are raised, the number of times they are caused to drop in a given unit of time, and the rate at which tractor vehicle 100 drives the system, the operator can control not only the magnitude of the impact forces provided by hammers 110 and 112 but, also, the number of such impacts by each per unit length of reinforced pavement passing thereunder to be cracked by such impact blows.

Persons skilled in the mechanical arts will also appreciate that by suitable control of hydraulic cylinder 142, hammer supporting element 134 may be pivoted about its lower pivot 136. This enables the operator to alter the location of pivots 118 and 120 with respect to both the tractor vehicle 100 and the underlying reinforced pavement that is to be cracked and removed. Readjustment of the position of hammer supporting element 134 thus provides an additional variable to the operator and he can adjust it to control in a very precise manner the angle at which the impacting portions of first and second hammers 110 and 112 each make contact with the underlying reinforced pavement 148 being cracked thereby.

It is an important and significant feature of this invention that the operator is thus afforded precise and individual control over the magnitude of the impact blows provided by first and second hammers 110 and 112, the angles at which both of these hammers apply their respective impact forces to the underlying reinforced pavement, the frequency with which blows struck by hammers 110 and 112 are applied, and the rate at which the entire system advances onto the selected portion of reinforced pavement that is to be removed.

With the sophisticated computer-assisted controls now available to operate industrial equipment, any of a large number of known and commercially available computer-assisted controls may be employed to program such operational parameters. Such an operational program can be based on past experience with particular types of reinforced pavement, the detected condition of the reinforced pavement being removed, local exigencies, the condition of the underlying ground, and other parameters material to the operation. More than one operator may be engaged to perform as a team even when sophisticated controls are available.

Tractor vehicle 100 has a convenient towing force application point 156, best seen in FIG. 1A, preferably adjacent a front bumper thereof, at which may be attached one or more suitably rated towing members 158 for providing a forwardly directed towing force to element 200 working in concert with hammers 110 and 112.

Towable element 200, best seen in FIGS. 1B, 2B, 9 and 10 in side elevation and perspective views, receives the towing force applied by a towing member 158 at a pivot point 202 provided on an extension 204 connected to a wedge 206 that has an upper surface 208 and a lower surface 210 meeting at a leading edge portion 212. See also, for example, FIG. 3C in which edge portion 212 of wedge 206 is indicated by a broken line. In practice, there will preferably be two extensions 204, one at each side of wedge 206. Each extension 204 is also provided with a pivot point 214 at which an upward force is flexibly applied, preferably by a strong link chain 216, to support a portion of the load represented by the weight of wedge 206, the weight of "cracked" reinforced pavement identified as 218 for convenience of reference, and a downward component of the reaction force exerted by the weight and stiffness of hitherto unbroken reinforced pavement 148. Also, and very important int he present context, the support element 216, whether it is a link chain, a steel cable or the like, must also be flexible and strong enough to cope with the stresses imposed by repeated impacts by both first and second hammers 110 and 112 during use.

A rear portion of wedge 206 is pivotally supported at each side at a pivot 218 that is itself supported at a distal end of a swingable link 220 pivotally supported at another end at a pivot 222. For proper balance during operation, there should be at least one link 220 on each side of wedge 206. Note that end plates 224 may also be provided on each side of wedge 206 to guide cracked pavement upward along the upper surface 208 of wedge 206.

An upper end of suspension element 216 may be adjusted in height for operation of a suspension assembly 224 that includes at least one tension spring and may include damping means of known kind, e.g., similar to a shock absorber structure in tension, to provide a flexible support to wedge 206 that is also somewhat elastic in the vertical direction. Suspension assembly 224 is pivotally supported at pivot 226 at the end of a cantilever arm 228 which is itself supported in part by a vertically adjustable hydraulic cylinder 230 that can move up and down along a vertical member 232 pivotally supported bout the same axis as pneumatic support wheels 234 of mobile unit 200. Each wheel 234, one on each side of unit 200, has a corresponding individually vertically adjustable hydraulic cylinder 230 thereabove. This provides the operator with the facility to cope even with very uneven and non-planar expanses of damaged reinforced pavement.

Arm 228 is attached not only to cylinder 230 but also to an arm 236 extending on an opposite side thereof and pivotally connected at a pivot 238 at a distal end. Pivot 238 is supported on a portion of the structure of mobile unit 200.

The entire structure described thus far, through the use of appropriate hydraulic cylinders and controls associated therewith, can be used by the operator to adjust the vertical height of pivot 226, and thus an intermediate point of wedge 206, as well as to concurrently adjust the height of pivot 220 supporting the rear end of wedge 206 with respect to the underlying ground 150. This is best understood with reference to FIG. 2B. Persons skilled in the mechanical arts will immediately appreciate that this structure enables wedge 206 to, in essence, "float" as it advances at its forward leading edge 212 under hitherto uncracked reinforced pavement 148.

A very important advantage of this structure, during use, is that the impacts by hammers 110 and 112 generate intense compressive forces downwardly from the upper surface of the approaching reinforcement pavement layer in a manner that initiates separation of the bulk component of the pavement from any reinforcement contained therein. An analogy may be drawn with the case of a person holding a substantial piece of ice in one hand and hitting it with a heavy hammer on the top surface thereof. Most of the energy carried in the falling hammer will then be absorbed in the flexibly and elastically supported piece of ice and cracks will propagate downward into it from its uppermost surface where it was struck. In exactly the same manner, the flexibly and elastically supported floating wedge enables each of the falling hammers to transmit its kinetic energy at the moment of impact to provide energy that stresses the bulk component, e.g., concrete in most reinforced pavements, so as to crack the same and loosen it with respect to the conventional reinforcement bars or netting contained therein. Note that portions of the vertical elasticity are provided by pneumatic tires of wheels 234, the compressibility of hydraulic fluid in cylinder 230, possible extension of the spring in support assembly 224 and the "planing" suspended action of wedge 206. The net effect is to facilitate the initiation and propagation of cracks in the approaching reinforced pavement.

It is believed that for reinforced pavement of approximately nine inches thickness as is common in highway construction in the United States, lifting, the forward hammers 110 and rear hammers 112 to a height of approximately three feet above the reinforced pavement, with each hammer weighing approximately 12,000 pounds, and sequential impacting of the hammers at a rate that generates at least one impact (from either one of the hammers) for approximately each inch of travel by the hammers with respect to the reinforced pavement, produces highly efficient cracking of concrete from reinforcement bars in the pavement. Actually, it is always the prevailing circumstances that must dictate appropriate adjustment of all operating parameters. An operator or "operator team" skilled in the use of the described invention should be able to adjust such parameters as necessary during use of the system utilizing both the capabilities of the MPRS and their own judgment based on experience.

As the cracked reinforced pavement passes the rear portion of wedge 206 it reaches a flat conveyor belt 240 that enables it to reach a predetermined height at which a full-width, sharp-pronged, high-speed, power-driven roller 242 operates to pull the cracked pavement upward while crushing the bulk component thereof into small pieces. This is best understood with reference to FIGS. 2B and 8. The broken pieces 264 of the bulk component then fall downward across the full width of the approaching reinforced pavement and are guided by metal guides 244, which preferably are freely rotatable belt conveyors inclined downwardly and inwardly of unit 200, whereby the pieces 264 of the bulk component are guided to a narrower conveyor belt 246. For symmetry, similar guides 244 are provided at both sides of conveyor belt 246, as best understood with reference to FIG. 3B. This conveyor belt 246 then raises the pieces 264 of the bulk component, now separated from the reinforcement 266 in the original pavement and carries the same, as best understood with reference to FIG. 1C to a discharge end through which the flow of bulk component pieces 264 may optionally be delivered to the vehicle 400.

When the system, as described so far, is all that is employed in a given situation, essentially only to "harvest" existing pavement, the system operator can be advised by prearranged signal by the driver of truck 400 when the latter has a full load. The system operator may then temporarily slow down the system or shut off conveyor belt 246 until a replacement truck 400 is again positioned below delivery end 248 and maintains motion in accordance with rest of the system.

The final breakdown of the bulk component into smaller pieces 264 and the effective separation thereof from reinforcement 266 contained with the original reinforced pavement is strongly facilitated by an impacting hammer 250 operated by hydraulic cylinder 252 at an upper portion of unit 200. Directly below the impacting face of hammer 250 is provided a plurality of steel bars 254 substantially normal thereto, as best understood with reference to FIGS. 2B and 7.

The Mengel reference, U.S. Pat. No. 4,692,058, cited earlier, illustrates in FIG. 2 and discusses in column 4, line 67, through column 5, line 19, thereof, the manner in which sawtooth profile 256 of hammer 250 coacts with bars 254 (as numbered here) to render the reinforced pavement. This portion of the Mengel reference is incorporated herein by reference for this aspect of its teaching. In the present invention, unlike Mengel, the intensity of the impact of hammer 250 is controlled so that only the bulk component is broken into pieces 264 that fall between bars 254 to be guided by guides 244 to conveyor belt 246 as previously described. The reinforcement 266, most likely metal bars or netting, is not broken with the bulk component by hammer 250 but, instead, may be optionally passed to a hydraulically operated guillotine 258 actuated by hydraulic cylinder 260 that essentially chops the reinforcement 266 into pieces 268 and to convey the same by means of a transverse conveyor belt 262 to one side of the moving system delivery to a truck 500 for subsequent removal thereof. This is best understood with reference to FIG. 3C.

The entire process, the previous description having been understood, will become clearer by reference to FIG. 8 wherein it is seen how pieces 264 of the bulk component are separated from reinforcement 266 by hammer 250 and steel bars 254 to fall downward between the bars 254, as reinforcement material 266 is chopped by guillotine 258 into pieces 268 that fall on conveyor belt 262 for subsequent disposal thereof.

For a proper understanding of the structure of bar hammer 112, reference may be had to FIGS. 4 and 5 which illustrate how detachable inserts 270 are connected at the impact portion of hammer 112 to cooperate with other similarly attached and particularly shaped impact elements 272. The provision of detachable impact elements such as 270 and 272, these being shaped to localize and intensify the impact force, will apply strong compressive stresses from the uppermost surface and into the bulk material of the reinforcement pavement to expedite the operation of the system.

FIG. 6 illustrates a similar structure with detachable impact force transmitting elements 274 (shaped generally like elements 272 of hammer 112) as utilized with hammer 110, which makes the first gravity-assisted impacts on the approaching reinforced pavement.

As is well known, the typical width of a highway in the United States is greater than twelve feet, the magnitude of the width of wedge 206 that is probably practical for safe use. Under such circumstances, by suitable attachment of an element such as 274 (see FIG. 6) at one end of hammer 110, the operator utilizing only mobile unit 100 can proceed at a relatively fast pace to generate a relatively narrow series of closely spaced lane separating cracks 276, as best seen in FIG. 3A. Thus, by making one early pass along a suitable length of a relatively wide stretch of reinforced pavement, the operator readies a section of a width that can be comfortably handled by the full width of wedge 206. This inherent lane separation feature is also a particular advantage of the present system in its preferred embodiment. Its utility is particularly pronounced when, for example, a relatively wide stretch of reinforced pavement, e.g., portion of an aircraft landing area or an expanse of pavement in a shopping mall, is to be removed by the system so as to separate the bulk component from the reinforcement component previously described. Making suitable passes with the length separator element, the operator can define strips of the reinforced pavement that can be tackled by the driven floating wedge 206 and a very wide expanse of reinforced pavement can thus be rapidly and easily removed in a highly efficient and expeditious manner.

As described hereinabove, units 100, 200, 300, 400 and 500, as best understood with reference to FIGS. 1 and 1A–1C, form a combination of elements sufficient to "harvest" existing pavement that is to be removed and rendered into broken concrete material, with chopped up reinforcement material separated therefrom for separate disposal. The entire MPRS also includes one or more pieces of equipment to accomplish the broader objective of either leaving behind a partially repaired surface for completion into a finished paved surface at a later date or, optionally, immediate and continuous formation of a finished paved surface in the wake of the MPRS as it moves on. How these further objectives may be achieved according to other different embodiments of this invention is described hereinbelow.

As an initial matter, it may be noted that the perspective view of the complete MPRS per FIG. 1 does not show at the very front of tractor unit 100 on a platform 104 a hydraulic pressurization unit 106 with its own independent drive engine, as illustrated in FIG. 1A. By this, it is intended to indicate that this particular location for a hydraulic pressurization unit 106 is optional. Thus, in FIG. 1, such a unit could be placed immediately behind the cab of tractor unit 100. Similarly, FIGS. 1C, 3B and 3C indicate how the rendered bulk component of the harvested pavement may be carried away in a truck 400 while the chopped-up reinforcement material separated from the bulk component may be carried away by a truck 500. FIG. 1, only for the sake of completeness of showing all components, indicates how truck 500 may be utilized with the complete MPRS to receive and remove from the site of the harvested pavement the reinforcement material salvaged from the removed existing pavement. FIG. 1 also indicates how, optionally, the bulk component obtained from the harvested existing pavement may be further processed to achieve the broader objective of the present invention.

Figure 9:
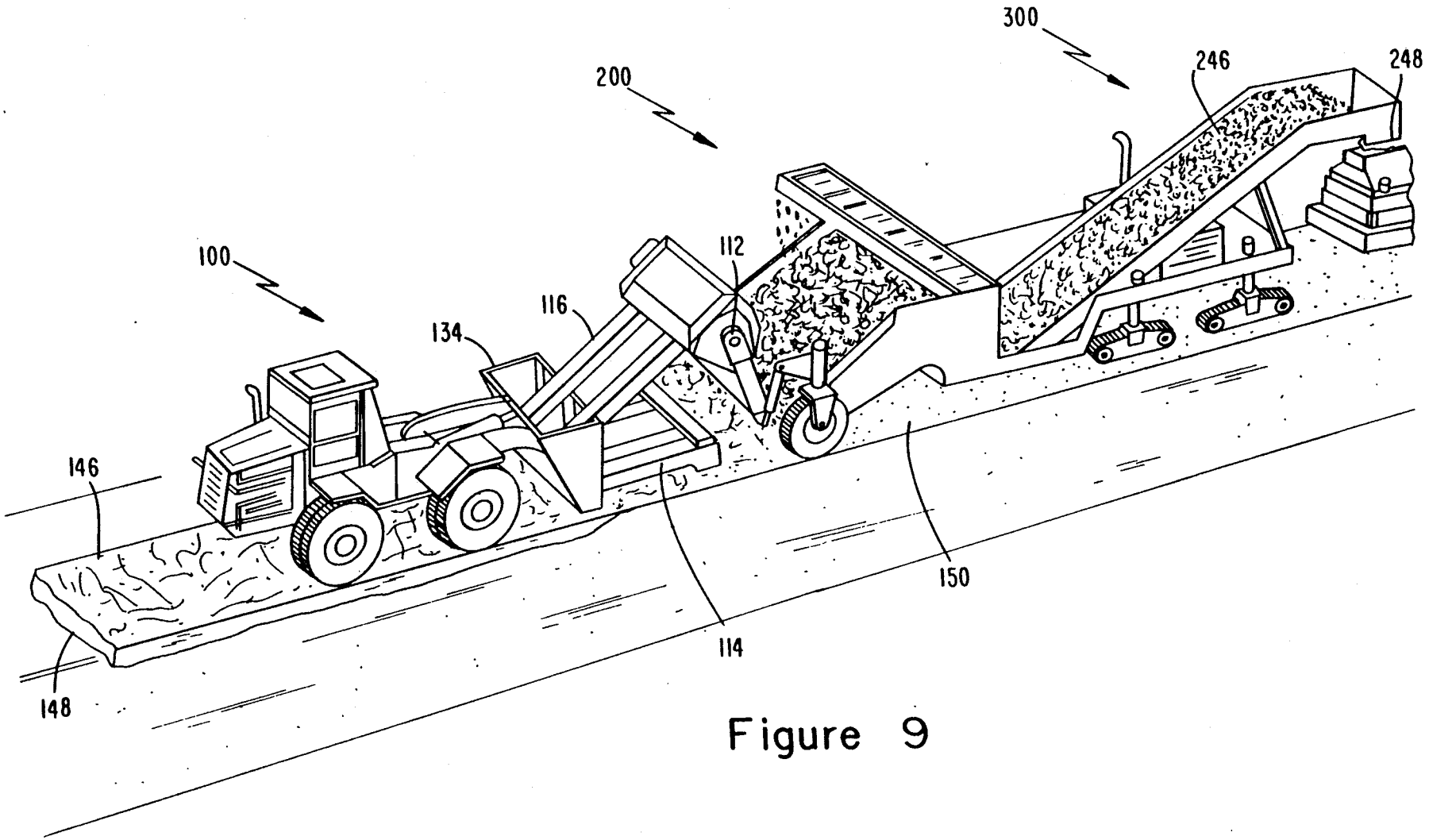
FIG. 9 is a perspective view of the forwardmost coacting units of the MPRS, particularly those which remove and render an existing pavement.
Figure 10:
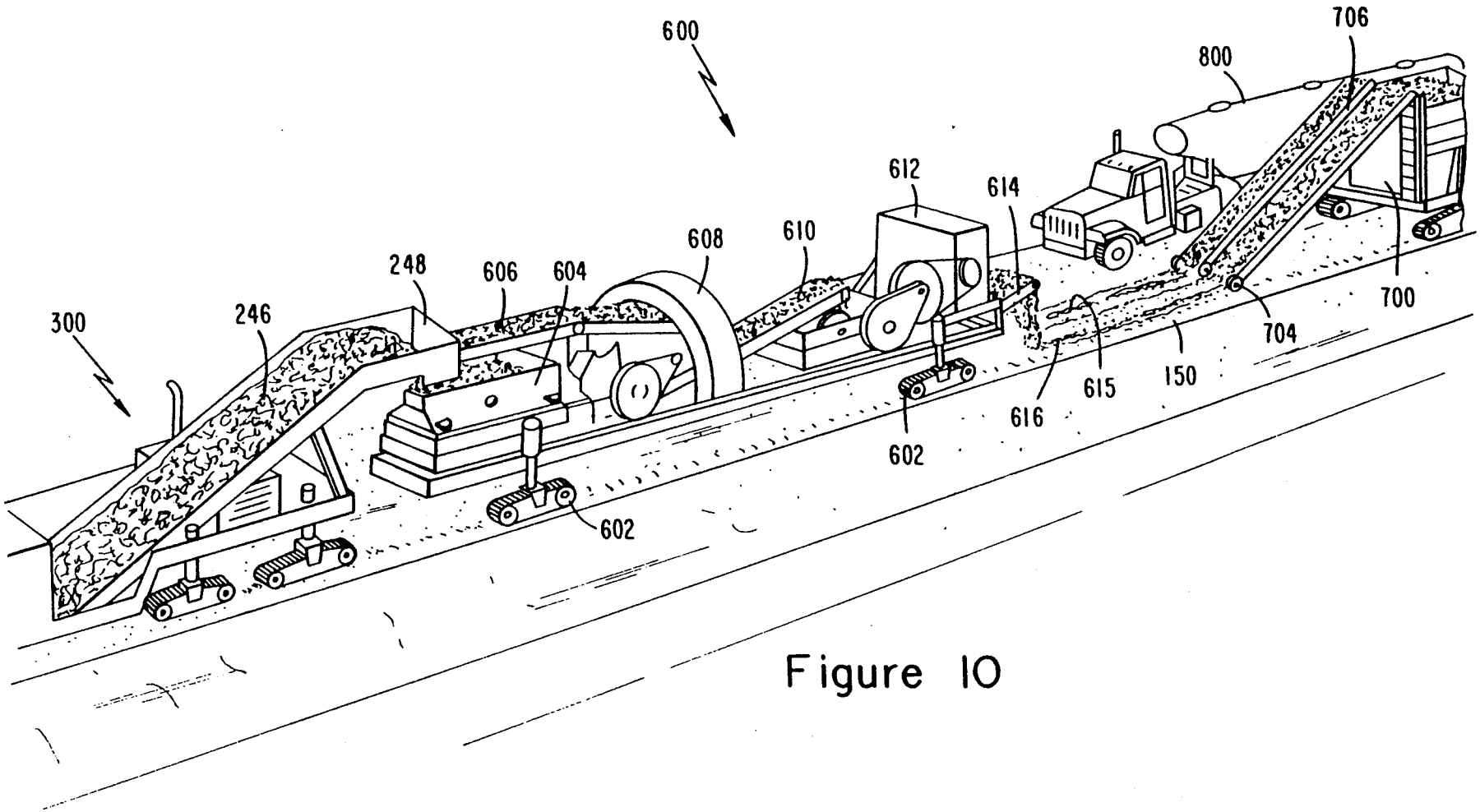
FIG. 10 is a perspective view of the central coacting units of the MPRS, particularly those which further process the rendered bulk component obtained by breaking up the removed pavement to put it in condition for reuse in forming new pavement.

Referring now to FIG. 9, it is seen how existing pavement 148 is lifted by towable element 200 (as best seen in FIG. 2A) broken, and processed to remove the reinforcement material therefrom and to deliver the flow of the recovered broken bulk component material 246 for delivery through a hopper 248. As best seen in FIG. 10, the flow of recovered broken bulk component material 246 may be dropped through hopper 248 into a receiving end of a mobile unit 600 which is a size reduction and screening processor unit 600 (SRSP, hereinafter).

The SRSP 600 is relatively large and heavy and is most conveniently supported on mobile track supports 602 on either side at its front and rear ends. The front end of SRSP 600 is provided with a receiving hopper 604 to receive pieces of less than a predetermined size as they fall through a screen (not shown for simplicity) at the bottom of hopper 248. Larger pieces of the broken harvested bulk component 246 are dropped onto a conveyor belt 606 and carried to a size reduction device 608 of known type where the larger pieces of the bulk component are broken down to a size approximately compatible with the size of the smaller pieces received in hopper 604 from which they are removed and deposited on the same belt as a reduced material flow 610. This flow of reduced material is then provided to a second size reduction device 612, also of known type, wherein the material is further broken up to the desired extent. As persons skilled in the relevant art will appreciate, any device that seeks to forcibly break relatively hard material such as the harvested bulk component, essentially concrete that is cured over the years, will reduce the same to smaller pieces of varying smaller sizes.

Depending on where a replacement pavement is to be laid, e.g., over sandy soil, in an area where very heavy traffic is expected, or in a location where the ground may contain unstable materials, it may be necessary to produce replacement pavement to specified "recipes." In other words, competent authorities, e.g., the state highway authority, may well require a road construction contractor to blend assorted materials in specific blends to generate acceptable replacement pavement. Known types of material reducing devices, such as 612 positioned at the rear end of SRSP unit 600, allow a user to adjust the operation to deliver the finally processed material in selected sizes. FIG. 10 illustrates a circumstance in which, in exemplary manner, the material broken down by reduction unit 612 is conveyed through screening delivery section 614 into two streams 615 and 616, each of which contains material within a predetermined size range with the proportions delivered in streams 615 and 616 controlled by the operator of the apparatus. Typically, road bed concrete may contain a predetermined portion which is 1½ inch aggregate with the rest being ½ to ¾ inch aggregate. It should be understood that production and delivery of the broken material into two streams of aggregate of predetermined size is only an option and that, for example, a single evenly distributed flow could also be produced and delivered by SRSP 600.

Given the circumstance in which the broken material is delivered as two streams 615 and 616 laid in "windrows" on the exposed ground surface 150, a continuous dynamic mixer unit 700 conveniently follows at an appropriate synchronous or controlled speed to pick up the windrows of material for further processing. As best understood now with reference to FIG. 11, the continuous dynamic mixer unit 700 is also a relatively heavy unit that is most conveniently supported on tracked supports 702 on either side at its front and back. Dynamic mixer unit 700 has a cantilevered conveyor belt system 704 supported at its front, road-supported on wheels 706. Cantilevered system 704 may be of any known type suitable for picking up the windrows of broken material laid by the SRSP moving on in front of unit 700. The broken material picked up by conveyor 704 is delivered in two streams to a partitioned hopper 708 to be held in two separate reservoirs. Another hopper 710 is provided immediately adjacent to and behind hopper 708 and is utilized to receive therein a binder material provided in any known manner from a mobile supply of cement, e.g., a cement truck 800. Continuous dynamic mixer 700 continuously removes from the compartmented reservoirs of hopper 708 aggregate material to be mixed with the cement hopper 710, the mixing being most conveniently performed in a mixer section 712 which then delivers a flow of freshly mixed concrete material as a layer 714 immediately behind unit 700.

Figure 11:
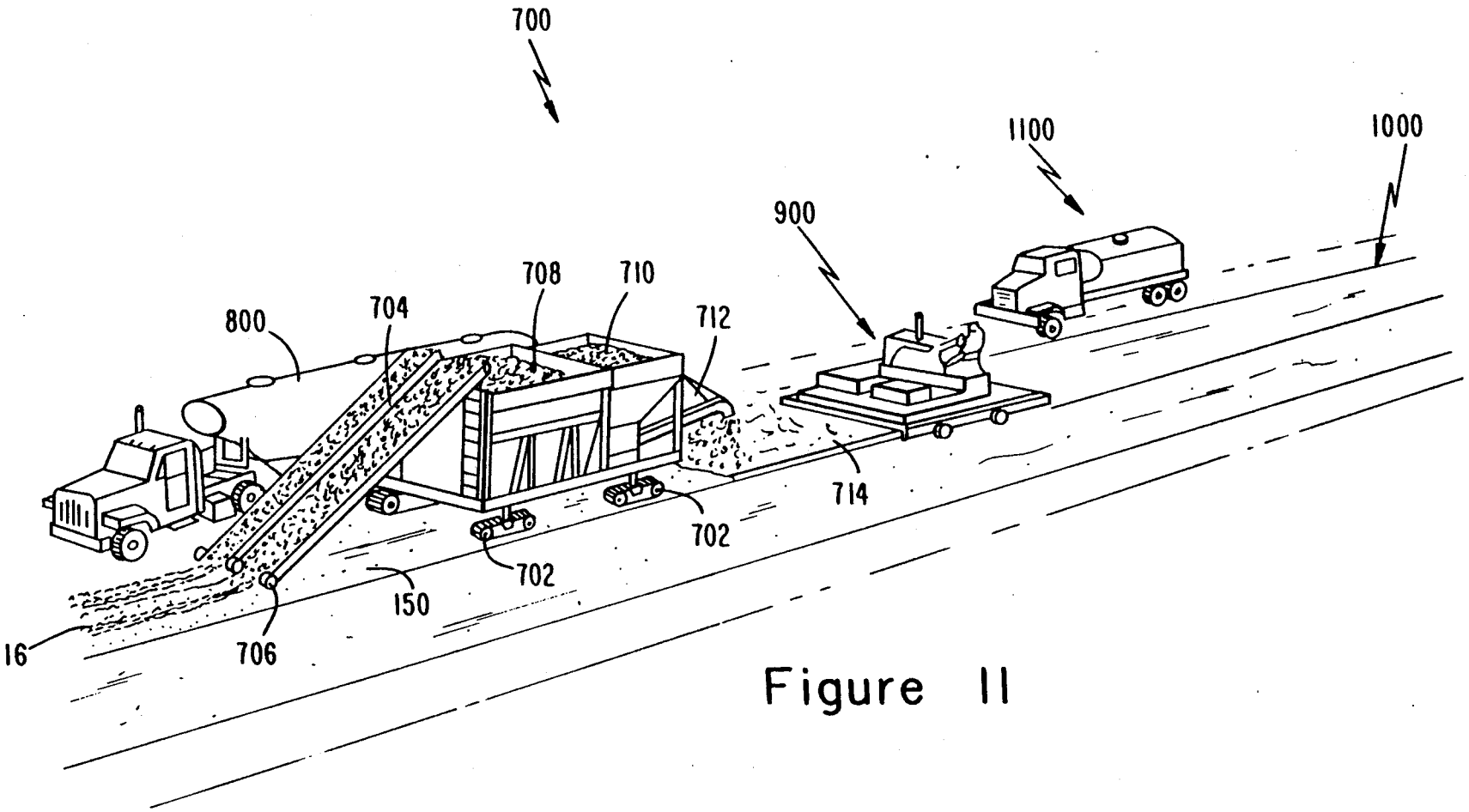
FIG. 11 is a perspective view of the rearmost coacting units of the MPRS, particularly those which combine the processed bulk component of the removed pavement with new reinforcement and binding materials to form new replacement pavement.

It will be appreciated that up to this point the freshly prepared and laid concrete does not contain any reinforcement material not accidently left behind in the processing of the harvested removed pavement. Unit 900, best in FIG. 11, is what is conveniently known as a "slip form" in the road making industry. Such units of known type typically perform the function of spreading the newly delivered concrete layer 714 to the desired width while shaking and vibrating the same to eliminate voids and to more evenly distribute the concrete between sliding vibrating forms that further define the precise width of the newly laid pavement. Such slip forms can, optionally, also be provided with known means for pushing into the newly laid concrete bed steel rods to reinforce the newly-laid pavement.

In another alternative, sufficient room may be left behind the tail end 712 of continuous dynamic mixer 700 and the front end of slip form 900 to allow access to the newly laid concrete by any known means for pushing therein steel reinforcement material in any suitable form.

Such devices and their use are well known in the industry and the available options are many. It is, therefore, believed that this discussion of exemplary options is sufficient to indicate the nature of choices available in practicing the present invention. Therefore, whether reinforcement material is placed into the newly laid layer of concrete 714 by slip form 900 or by any other comparable means, the result is that as the MPRS moves on, from the rear end of slip form 900 there extends a newly-laid length of pavement 1000 of suitable width and composition and optionally inclusive of new reinforcement material. Depending on the specific needs of the particular road-making project at hand, water may be sprayed over the newly-laid concrete, or the concrete may be covered by selected sealing material in continuous manner, from one or more trucks such as truck 1100 illustrated in FIG. 11 in exemplary manner. Such finishing touches may utilize known apparatus and methods in conjunction with the combination of elements and method steps that constitute the present invention.

As will be appreciated, if it was not important to form a new pavement immediately after harvesting of the old, the broken bulk component material could be reduced in size and left behind in one or more windrows, e.g., 615 and 616 behind the SRSP. Such a circumstance could arise, for example, if impending bad weather would make it injudicious to form and lay concrete for the new pavement at a particular time. In other words, part of the complete train forming the MPRS, as described hereinabove, could be utilized to accomplish less than the maximum available result possible through use of the complete system. This done, the contractor using this apparatus could, at a later and more suitable time, provide the mobile mixer unit 700, provide cement thereto from cement trucks 800, and operate strip form 900 to form the new pavement 1000. Depending on the speed of operation of this combination of units, these pieces of equipment could process their way to catch up with units 100 through 600 that may be operating ahead of them. It will be seen, therefore, that the present invention allows a user great flexibility to accommodate himself to varying local terrains, changing weather conditions, and assorted needs. The combination of the novel elements that enable continuous harvesting of old pavement with known units for reducing the size of harvested components and mixing and laying of concrete formed therefrom thus presents very versatile apparatus and methods for road construction.

It is expected that persons skilled in the art, upon developing an understanding of the foregoing disclosure, will consider utilizing obvious variations and equivalence of various aspects of the disclosed invention. Such variations within the spirit of this disclosure believed to be comprehended within the scope of the disclosed invention as defined by the claims appended hereto.

What is claimed is:

1. A mobile pavement replacement system for advancing at a user-controlled rate on an existing layer of reinforced pavement to continuously remove the same to separate a bulk component thereof from a reinforcement component present therein and to deliver the same separately in rendered form, comprising:

driving means for providing a forward drive to the system;

movable lifting means driven forwardly by the drive means for thereby lifting a predetermined width of approaching reinforced pavement;

movable impact means for applying a plurality of gravity-assisted controlled impact forces to the lifted reinforced pavement to generate successive cracks therein substantially across said width thereof;

movable first means for rendering into pieces within a first size range a bulk component of the cracked reinforced pavement, separating the bulk component pieces from a reinforcement component and delivering the separated bulk component pieces in a first flow;

movable second means for rendering the separated reinforcement component into pieces within a second size range and delivering the same in a second flow, both the bulk component rendering means and the reinforcement component rendering means being adapted to move in concert with the lifting means and the impact means;

movable third means for receiving said first flow of said bulk component pieces, further rendering at least a first portion of the first flow into smaller pieces within a third size range and for delivering the same in a third flow for subsequent mixing thereof with a selected binding material to form a layer of replacement pavement.

2. A mobile pavement replacement system according to claim 1, wherein:

said movable lifting means comprises an acute angle non-rigidly supported wedge that is forcibly driven under an approaching portion of the reinforced pavement to lift and move the same relative to a leading horizontal edge portion of the wedge over an upwardly inclined first face thereof.

3. A mobile pavement replacement system according to claim 2, wherein:

said movable impact means is adapted to apply a first controlled impact force to an upper surface of the lifted reinforced pavement substantially over and along said edge portion of the wedge.

4. A mobile pavement replacement system according to claim 3, wherein:

said movable impact means is adapted to apply a second controlled impact force to said upper surface of the lifted reinforced pavement over a first surface of the wedge behind and above the edge portion.

5. A mobile pavement replacement system according to claim 2, further comprising:

means for pivotally supporting the wedge at a rear portion thereof.

6. A mobile pavement replacement system according to claim 5, further comprising:

means for pivotally supporting the wedge at a point intermediate the leading edge portion and the rear portion thereof.

7. A mobile pavement replacement system according to claim 6, further comprising:

movable elastic support means for providing controlled elastic support in the vertical direction to said rear portion support means and said intermediate portion support means.

8. A mobile pavement replacement system according to claim 1, wherein:

said movable third means comprises a fourth means for rendering a second portion of the first flow into smaller pieces within a fourth size range and for delivering the same in a fourth flow, for subsequent mixing thereof with said pieces of said third flow and said binding material to form said layer of replacement pavement, said movable third and fourth means being controllable to adjust said first and second portions in a predetermined manner.

9. A mobile pavement replacement system according to claim 8, wherein:

said movable third and fourth means are operable to deliver said respective third and fourth flows therefrom in the form of windrows laid on a ground surface from which any previously existing pavement has been removed.

10. A mobile pavement replacement system according to claim 8, further comprising:

movable continuous mixing means for receiving said third and fourth flows and said selected binding material, mixing the same in predetermined ratios and delivering the resultant mixture at a delivery end in a distributed flow over a ground surface to form said replacement pavement thereon.

11. A mobile pavement replacement system according to claim 10, further comprising:

movable reinforcement adding means for placing reinforcement material into said distributed mixture prior to curing thereof, to provide reinforcement in said replacement pavement formed thereby upon said curing.

12. A mobile pavement replacement system according to claim 11, further comprising:

movable slip form means for forming said distributed flow into a predetermined width to form said replacement pavement accordingly.

13. A mobile pavement replacement system according to claim 11, further comprising:

movable slip form means for forming said distributed flow into a predetermined width to form said replacement pavement accordingly.

14. A mobile pavement replacement system according to claim 1, further comprising:

movable continuous mixing means for receiving said third flow and said selected binding material, mixing the same in a predetermined ratio and delivering the resultant mixture at a delivery end in a distributed flow over a ground surface to form said replacement pavement thereon.

15. A method for continuously replacing pavement by breaking up and removing existing reinforced pavement, simultaneously separating a bulk component thereof from a reinforcement component and delivering small pieces thereof in two separate flows for utilization of the recovered bulk component pieces in forming the replacement pavement, comprising the steps of:

forcibly driving a flexibly suspended acute-angled elongate wedge having a horizontal forward edge under an approaching portion of reinforced pavement;

applying a first plurality of blows onto an upper surface of reinforced pavement over an upper surface of the wedge to crack the reinforced pavement;

applying a second plurality of blows onto an upper surface of the cracked reinforced pavement supported over a plurality of spaced-apart bars to break up into small pieces a bulk component of the reinforced pavement from a reinforcement component thereof;

applying a cutting force to cut the reinforcement component into small pieces;

delivering the small pieces of the bulk component and the reinforced component separately; and, rendering at least a first portion of the small pieces of the bulk component into smaller pieces within a first size range to form a first aggregate;

mixing a binder material with said first aggregate to form replacement pavement material therefrom.

16. A method for continuously replacing pavement according to claim 15, comprising the further step of:

forming said replacement pavement material into a length of replacement pavement of a predetermined width.

17. A method for continuously replacing pavement according to claim 16, comprising the further step of:

adding reinforcement material to said replacement pavement material prior to curing thereof to reinforce the replacement pavement formed thereby.

* * * * *